US008225700B2

(12) United States Patent
Hile

(10) Patent No.: US 8,225,700 B2
(45) Date of Patent: Jul. 24, 2012

(54) LOCKING PLIERS WITH QUICK JAW RELEASE

(76) Inventor: Jeffrey B. Hile, Wexford, PA (US)

( * ) Notice: Subject to any disclaimer, the term of this patent is extended or adjusted under 35 U.S.C. 154(b) by 449 days.

(21) Appl. No.: 12/462,916

(22) Filed: Aug. 12, 2009

(65) Prior Publication Data

US 2010/0186558 A1 Jul. 29, 2010

Related U.S. Application Data

(60) Provisional application No. 61/205,984, filed on Jan. 26, 2009.

(51) Int. Cl.
*B25B 7/12* (2006.01)

(52) U.S. Cl. ..... 81/368; 81/367; 81/370

(58) Field of Classification Search ..... 81/367, 81/368, 370
See application file for complete search history.

(56) References Cited

U.S. PATENT DOCUMENTS

| | | | | |
|---|---|---|---|---|
| 4,499,797 | A * | 2/1985 | Wilson | 81/367 |
| 6,065,376 | A | 5/2000 | Khachatoorian | |
| 6,095,019 | A * | 8/2000 | Warheit et al. | 81/370 |
| 6,199,459 | B1 | 3/2001 | Azhona | |
| 7,146,887 | B2 * | 12/2006 | Hunter | 81/367 |

* cited by examiner

*Primary Examiner* — Lee D Wilson
*Assistant Examiner* — Shantese McDonald
(74) *Attorney, Agent, or Firm* — Carothers & Carothers

(57) ABSTRACT

A jaw release mechanism for locking pliers which utilize an over-center toggle locking mechanism and wherein the normally stationary upper jaw of the pliers is pivotally fastened to the main body of the pliers. This normally stationary upper jaw is releaseably retained in a normally stationary position relative to the main body of the pliers by a thumb actuated trigger release mechanism whereby the locked pliers may be safely released with the same hand which grasps and manipulates the pliers.

16 Claims, 3 Drawing Sheets

LOCKING PLIERS WITH QUICK JAW RELEASE

CROSS REFERENCE

This application depends upon and claims the benefit of U.S. Provisional Application No. 61/205,984, filed Jan. 26, 2009, and entitled LOCKING PLIERS WITH QUICK JAW RELEASE, the contents of which are incorporated herein by reference.

BACKGROUND OF THE INVENTION

The present invention relates to pliers, and more particularly to a release mechanism for locking pliers.

Basically two types of locking pliers are available on the market. One type is self-adjusting or auto-adjusting locking pliers which have jaws that are self-adjusting according to the size of the workpiece to be grasped between the jaws, and the second type are locking pliers which do not incorporate self-adjusting capabilities. An example of self-adjusting locking pliers are disclosed in U.S. Pat. No. 6,941,844, issued to the present inventor. There are many examples of locking pliers which do not incorporate self-adjusting capabilities. As just a couple of examples, this type of non-adjusting plier is disclosed in U.S. Pat. No. 5,056,385, a locking plier sold under the trademark "VISE-GRIP" and U.S. Pat. No. 6,227,080.

All such locking pliers, whether self-adjusting or not, incorporate an "over-center" or "past-dead-center" compound toggle locking mechanism or linkage whereby when the movable jaw of the plier is rotated to seize a workpiece firmly between the movable and the fixed jaw as the handles are tightly compressed, the toggle mechanism locks the jaws onto the workpiece with extreme pressure.

All of the prior art locking pliers have a shortcoming in regard to the release mechanism to release the jaws. This is so because the stationary assembly of the locking pliers, including the upper jaw, the main body and the upper handle, as a whole functions as a spring element when the pliers are locked. Accordingly, the entire energy of the locking mechanism is stored up in the upper stationary assembly or handle.

Most such locking pliers either employ a release lever which is tripped to unlock the jaws or the handles are simply pulled apart. Because of the high energy stored in the upper stationary assembly of the pliers under locked conditions, the lower movable handle when released flings outward with a significant force which can cause injuries. Accidental openings can also occur with unintentional contact with the release lever which is usually positioned on the inside of the lower movable handle. In addition, to release the locked jaws one must either trip a release lever, normally on the lower movable handle, or pull the handles apart, and in any event this normally requires the use of two hands. It is not appropriately or easily possible to release the locked jaws with one hand, being the same hand that is manipulating the pliers.

SUMMARY OF THE INVENTION

The locking pliers of the present invention are provided with a quick release which may be easily thumb actuated with the same hand that manipulates the pliers, in such a manner that the energy stored within the upper stationary assembly of the pliers is quickly, safely and easily released by thumb manipulation with one hand (the same hand manipulating the pliers) without causing the lower movable handle to fling outwardly under extreme pressure.

As with all existing locking pliers, the locking pliers of the present invention include a stationary assembly, which incorporates a normally stationary upper jaw protruding forward from a stationary main body and a normally stationary upper handle protruding rearwardly from the main body, and a movable lower jaw pivotally secured to the stationary assembly. Further, a movable handle is coupled either directly or indirectly to the movable lower jaw for manipulation thereof. The movable handle in conventional fashion is pivotally linked to a beyond-center toggle locking mechanism to lock the jaws under pressure in a closed position against a workpiece.

The inventive feature of the locking pliers of the present invention, whether they be self-adjusting or not, is that the normally stationary upper jaw is pivotally secured to the stationary assembly or main body and a trigger release mechanism is provided which releaseably maintains this normally stationary upper jaw in a normally stationary position relative to the stationary assembly whereby the locked jaws are released when the trigger release mechanism is triggered to thereby permit the upper jaw to pivot relative to the remainder of the stationary assembly. Spring bias elements are provided to urge the upper jaw and the trigger release mechanism to return after release and thereby relock the upper jaw in its normally stationary position relative to the stationary assembly or main body.

The trigger release mechanism includes a release lever that is pivoted to the main body of the stationary assembly with an exposed end for thumb engagement and release actuation. The release lever releaseably engages the pivoted upper jaw for thereby retaining the upper jaw in its normally stationary position relative to the main body of the stationary assembly of the pliers. An indicator is provided to indicate when the upper jaw is in its normally stationary position.

The thumb actuated release mechanism of the present invention is applicable to any and all types of locking pliers whether they be self-adjusting or not.

BRIEF DESCRIPTION OF THE DRAWINGS

Other objects and advantages appear hereinafter in the following description and claims. The accompany drawings show, for the purpose of exemplification, without limiting the invention or appended claims, certain practical embodiments of the present invention wherein:

DETAILED DESCRIPTION OF A PREFERRED EMBODIMENT

Figure 1:
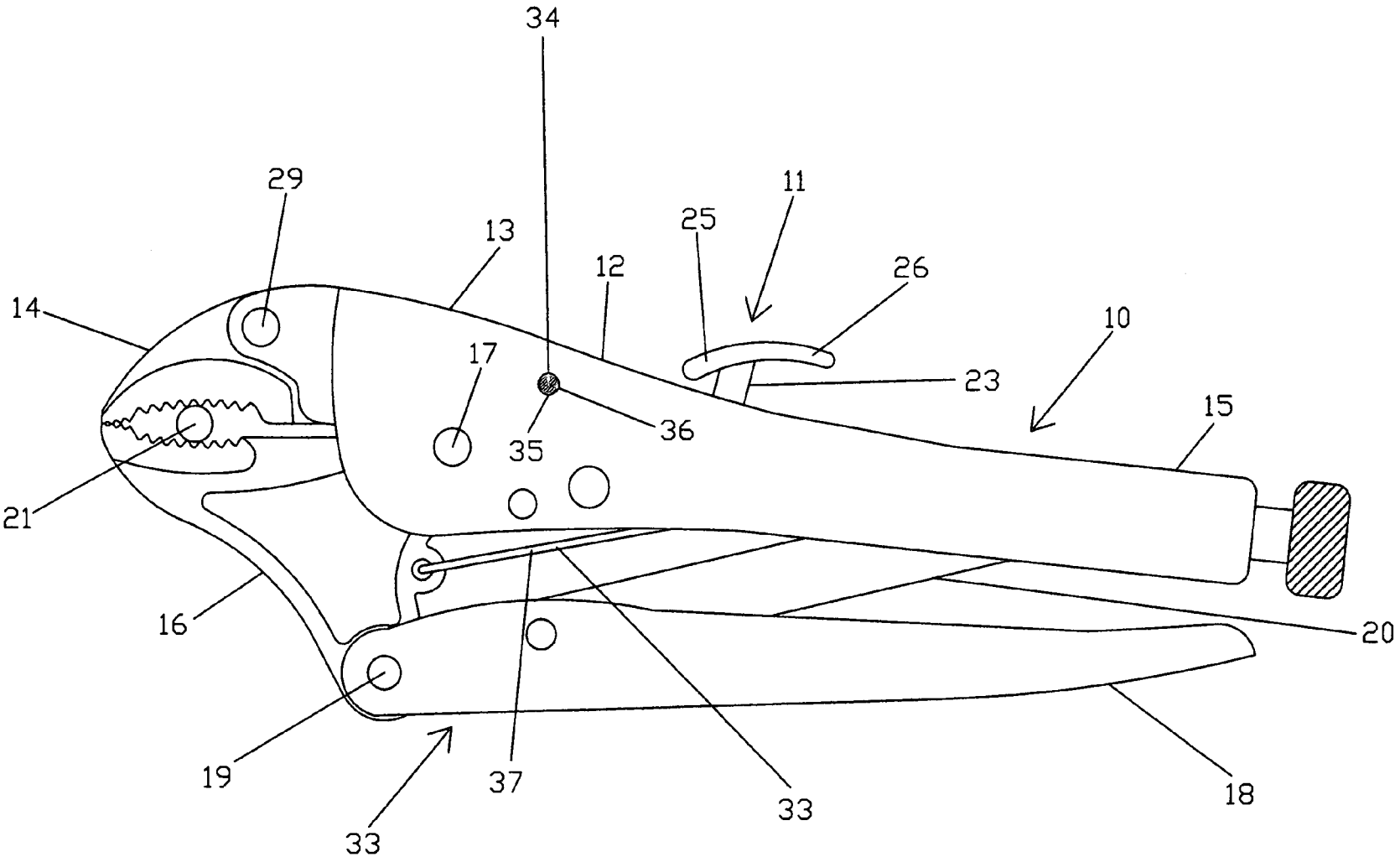
FIG. 1 is a view in side elevation of locking pliers in a locked state incorporating the quick jaw release mechanism of the present invention.

Referring to the drawings, the locking pliers 10 with the quick jaw release of the present invention, except for the thumb actuated jaw release mechanism 11 of the present invention, function in the same manner of those of the prior art. The particular locking pliers illustrated operate in an identical manner as those illustrated in U.S. Pat. No. 5,056,385, and accordingly, a detailed explanation of the basic operation of such locking pliers will not be provided. For a better understanding of the operation of such conventional locking pliers, reference is made to the afore-referenced patent which is incorporated herein by reference, the release mechanism of the present invention being applicable to any and all types of locking pliers whether they be self-adjusting or not.

The basic locking pliers illustrated include a stationary assembly 12 which includes or incorporates a main body 13, a forward protruding normally stationary upper jaw 14 and a normally stationary rearward extending upper handle 15. A movable assembly 33 includes movable lower jaw 16 pivotally secured at 17 to stationary assembly 12 or main body 13. The movable assembly 33 further includes movable handle 18 which is coupled to movable lower jaw 16 for manipulation thereof. In this representation lower handle 18 is directly pivoted at 19 to lower jaw 16. However, in other embodiments, such as illustrated in U.S. Pat. No. 6,941,844, the lower handle is pivoted directly to the main body 13 and is coupled through a linkage to movable lower jaw 16. The jaws 14 and 16 are shown here as conventional plier jaws, but may consist of any type or shape of jaw, including C-clamp type jaws.

Figure 2:
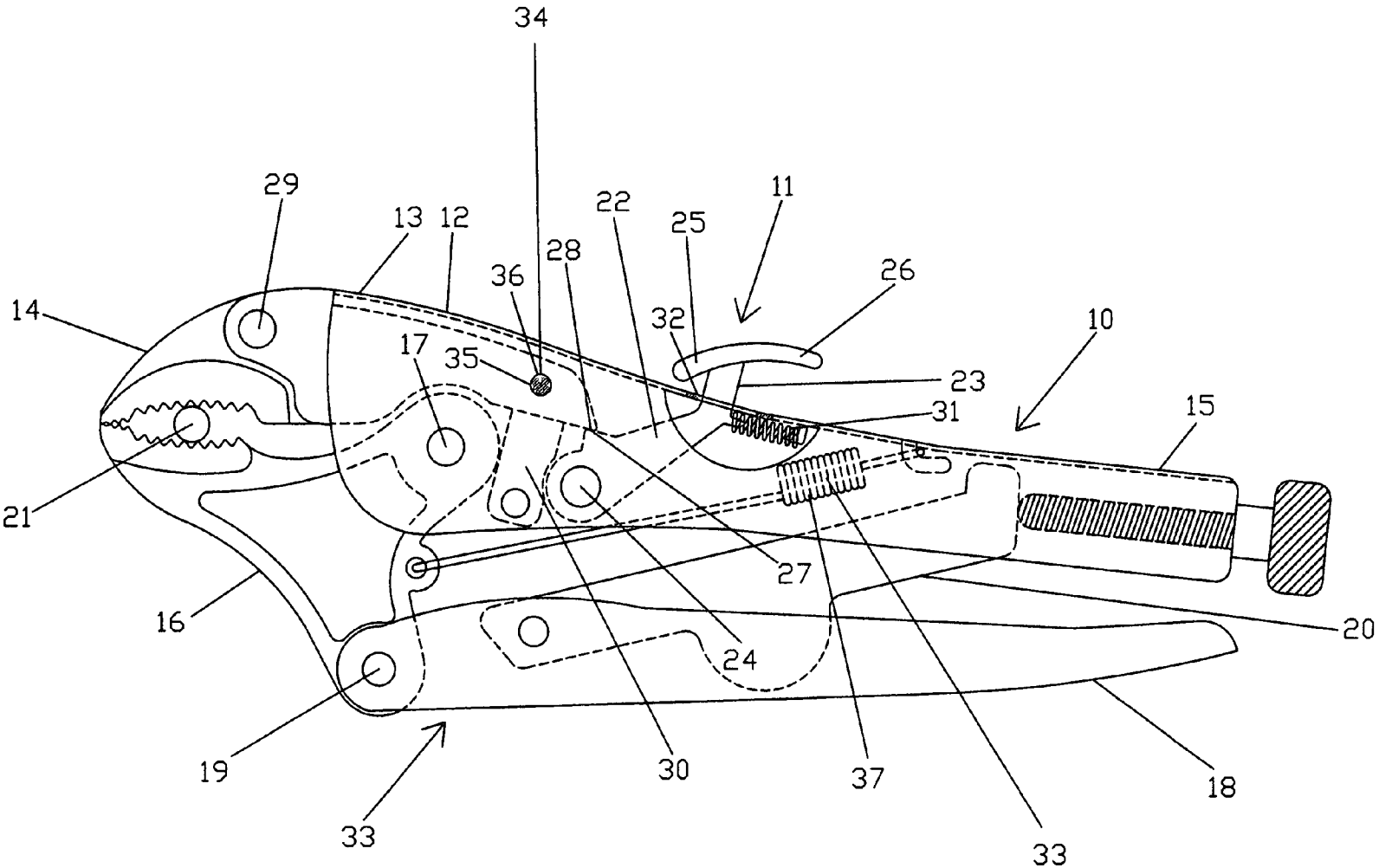
FIG. 2 is a view in side elevation of the pliers illustrated in FIG. 1 with interior elements illustrated in dashed outline, the figure illustrating the thumb actuated release mechanism of the present invention engaged for maintaining the upper jaw in a normally stationary position relative to the main body of the stationary assembly.

The movable assembly 33 further includes a linkage whereby movable handle 18 is pivotally linked to movable lower jaw 16 by a beyond-center toggle locking mechanism 20 which is retained in the beyond-center position to lock the jaws 14 and 16 in a closed position against workpiece 21 as illustrated in FIGS. 1 and 2. Mechanism 20 also includes spring 37 which merely holds mechanism 20 in place and holds lower jaw 16 open when the locking mechanism is open. The locking toggle mechanism 20, including spring 37, is conventional in the prior art and for an understanding of its operation, reference is made to the afore-mentioned patent.

Figure 3:
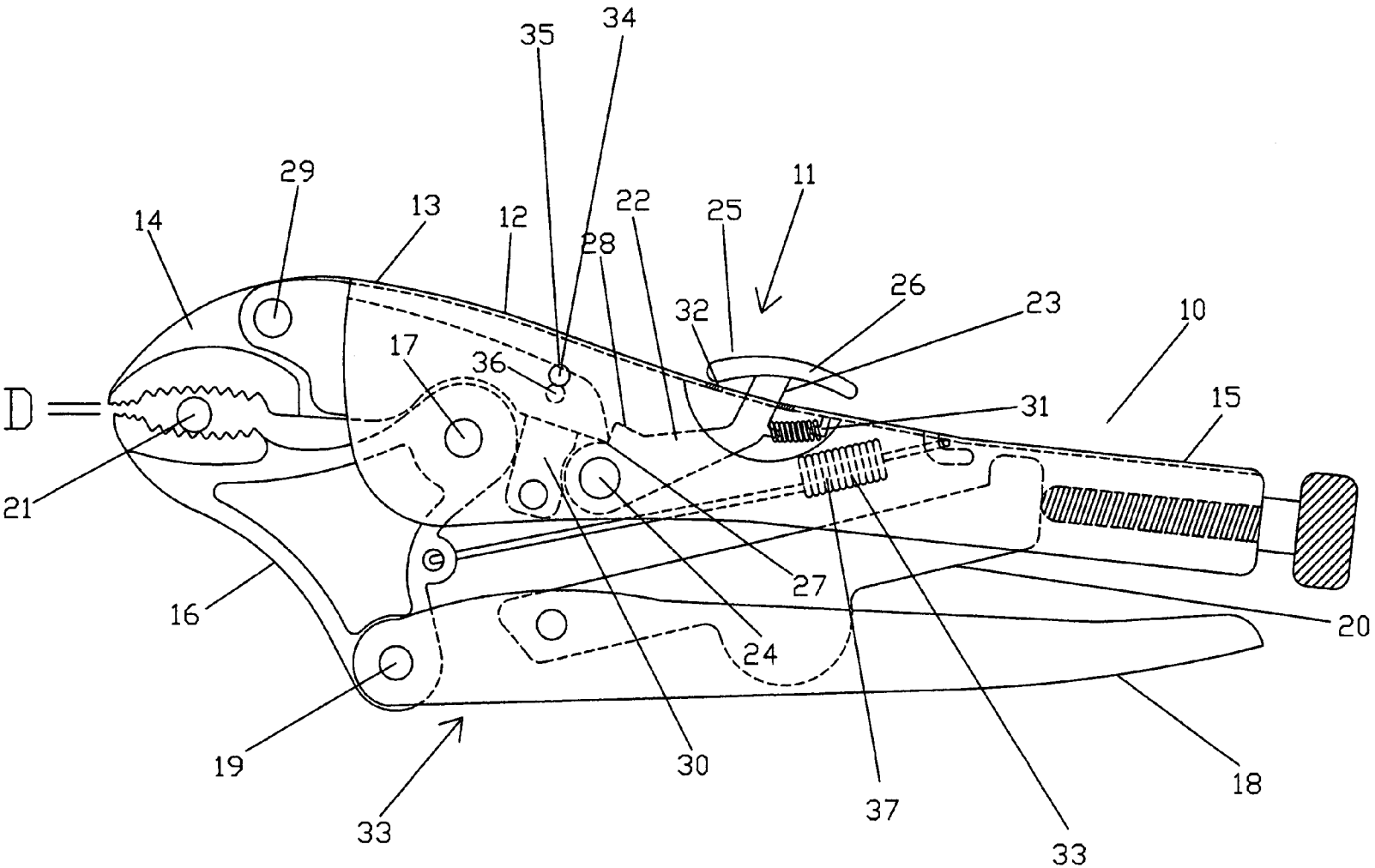
FIG. 3 is a view in side elevation of the pliers shown in FIGS. 1 and 2 with the thumb actuated trigger release mechanism illustrated in its triggered or actuated position at the time of release.

The jaw release mechanism 11 of the present invention is comprised of the combination of the normally stationary upper jaw 14 being pivotally fastened at 29 to main body 13 of stationary assembly 12 whereby normally stationary jaw 14 when released is permitted to rotate clockwise as viewed in the drawings thereby permitting the minute release distance D between the jaws as illustrated in FIG. 3.

As is best illustrated in FIG. 2, normally stationary upper jaw 14 is releaseably retained in the normally stationary position illustrated in FIG. 2 relative to main body 13 by the thumb actuated trigger release mechanism 22 of jaw release mechanism 11.

Trigger release mechanism 22 includes release lever 23 which is pivoted at 24 to main body 13 and is provided with an end 25 exposed for thumb engagement at 26 for release actuation whereby lever 23 is pulled downwardly and rearwardly or to the right in FIG. 2 by thumb engagement.

Release lever 23 engages pivoted upper jaw 14 at opposing lip 27 which rests upon step 28 of release lever 23.

Accordingly, when the jaws 14 and 16 are locked under pressure against workpiece 21, the jaws are released by thumb engagement at 26 on lever 23 which is thus pulled rearwardly by the thumb of the same plier operating hand whereby step 28 slips past opposing lip 27 of jaw 14 thereby releasing normally stationary upper jaw 14 to rotate about its pivot 29 to safely release the locking energy of the pliers.

Spring bias elements 30 and 31 respectively urge upper jaw 14 and trigger release mechanism 22 to return immediately after release, as illustrated in FIG. 3, to thereby relock upper jaw 14 in its normally stationary position relative to main body 13 as illustrated in FIG. 2. Spring element 30 is provided in the form of a rubber block which continually urges upper jaw 14 to rotate counterclockwise about pivot point 29 as viewed in FIG. 2, and spring element 31 is a compression spring element which continually urges lever 23 to rotate counterclockwise about its pivot 24 to ultimately engage stop 32 on main body 13.

An indicator 34 is provided for indicating when normally stationary jaw 14 is in the normally stationary position illustrated in FIGS. 1 and 2. Indicator 34 includes a window aperture 35 provided in stationary assembly 13 which exposes the indicating area 36 on normally stationary jaw 14 when the normally stationary jaw 13 is in the normally stationary position illustrated in FIGS. 1 and 2. Indicating area 36 on normally stationary jaw 14 only appears through window aperture 35 when it is aligned therewith when the normally stationary jaw 14 is in the normally stationary position.

Indicating area 36 is provided by a small dimple provided in jaw 14 which is painted in an appropriate bright visible neon color for easy visible indication through window aperture 35 when aligned therewith. When normally stationary jaw 14 is released to pivot about pivot 29 as illustrated in FIG. 3, the indicating area 36 is not aligned with window aperture 35 and the operator knows that the normally stationary jaw 13 is not in its locked normally stationary position and that the pliers are therefore not ready to use. When the indicating area 36 becomes visible through window aperture 35, then the operator knows that the pliers are ready to use. Indicator 34 is preferably provided on both sides of the pliers 10 so that the ready state of the pliers is indicated on both sides of the pliers depending upon in which hand the operator is using the pliers.

I claim:

1. Locking pliers with quick jaw release, said locking pliers including a stationary assembly having a normally stationary upper jaw and a normally stationary handle, a movable lower jaw pivotally secured to said stationary assembly, a movable handle coupled to said movable lower jaw for manipulation thereof, said movable handle pivotally linked to a toggle locking mechanism to lock said jaws in a closed position with pressure against a workpiece, and a release mechanism for releasing the locked jaws, said release mechanism comprising;

said normally stationary upper jaw pivotally secured to said stationary assembly and a trigger release mechanism releasably maintaining said upper jaw in a normally stationary position relative to said stationary assembly whereby said locked jaws are released when said trigger release mechanism is triggered to thereby permit said upper jaw to pivot relative to said normally stationary handle.

2. The locking pliers of claim 1, including spring bias elements urging said upper jaw and said trigger release mechanism to return after release and thereby lock said upper jaw in said normally stationary position relative to said stationary assembly.

3. In locking pliers having a normally stationary upper jaw fastened to a main body having a normally stationary handle, and a lower jaw pivotally attached to said main body and coupled to a movable handle for manipulating said lower jaw relative to said upper jaw, and an over-center toggle locking mechanism disposed between said movable handle and said main body for locking said jaws closed under spring bias against a workpiece when said handles are closed toward each other, the improvement comprising:

a jaw release mechanism comprised of said normally stationary upper jaw pivotally fastened to said main body and releaseably retained in a normally stationary position relative to said main body by a thumb actuated trigger release mechanism.

4. The locking pliers of claim 3, including spring bias elements urging said upper jaw and said trigger release mechanism to return after release and thereby relock said upper jaw in said normally stationary position relative to said main body.

5. Locking pliers comprising:

a normally stationary main body;

a normally stationary upper handle extending rearwardly from and secured to said main body;

an upper jaw pivotally secured to a forward end of said main body;

a trigger release mechanism on said main body releaseably retaining said upper jaw in a normally stationary position relative to said main body;

a lower jaw pivotally secured to said main body and positioned opposing said upper jaw for engagement of a workpiece therebetween;

a lower movable handle coupled to said lower jaw for manipulation thereof, said lower handle aligned with said upper handle for simultaneous grasping of said handles in one hand to close said handles toward each other to grasp a workpiece between said jaws; and an over-center toggle locking mechanism disposed between said lower handle and said main body for locking said jaws against a workpiece under pressure.

6. The locking pliers of claim 5, including spring bias elements urging said upper jaw and said trigger release mechanism to return after release to thereby relock said upper jaw in said normally stationary position relative to said main body.

7. The locking pliers of claim 6, said trigger release mechanism comprising a release lever pivoted to said main body with an end exposed for thumb engagement and release actuation, said release lever releaseably engaging said pivoted upper jaw for thereby retaining said upper jaw in said normally stationary position relative to said main body.

8. The locking pliers of claim 7, said release lever having a step engaging an opposing lip on said upper jaw rearwardly of said upper jaw pivot.

9. The locking pliers of claim 8, wherein one of said spring bias elements continuously urges said release lever against a stop on said main body when said upper jaw is in said normally stationary position.

10. Locking pliers comprising:

a stationary assembly having an elongated overall shape, wherein one end of said stationary assembly forms a stationary handle, and the other end of said stationary assembly forms a normally stationary jaw;

a movable assembly including a movable handle and a movable jaw that is pivotally supported on said stationary assembly, said movable handle coupled to said movable jaw for manipulation thereof to grasp a workpiece between said jaws;

said movable assembly further including a link mechanism pivotally connected between said movable handle, said movable jaw and said stationary handle and dimensioned whereby said movable jaw is caused to close toward said stationary jaw for clamping an item therebetween when said movable handle is moved toward said stationary handle and to provide an over-center locking toggle mechanism to lock said jaws under pressure against a workpiece; and a jaw release comprised of said stationary jaw pivotally fastened to said stationary assembly and releaseably retained in a normally stationary position relative to said stationary assembly by a trigger release.

11. The locking pliers of claim 10, including spring bias elements urging said normally stationary jaw and said trigger release to return after release to thereby relock said stationary jaw in said normally stationary position relative to said stationary assembly.

12. The locking pliers of claim 11, said trigger release comprising a release lever pivoted to said stationary assembly with an end exposed for thumb engagement and release actuation, said release lever releaseably engaging said pivoted normally stationary jaw for thereby retaining said normally stationary jaw in said normally stationary position relative to said stationary assembly body.

13. The locking pliers of claim 12, said release lever having a step engaging an opposing lip on said normally stationary jaw rearwardly of said normally stationary jaw pivot.

14. The locking pliers of claim 13, wherein one of said spring bias elements continuously urges said release lever against a stop on said stationary assembly when said normally stationary jaw is in said normally stationary position.

15. The locking pliers of claim 10, including an indicator for indicating when said normally stationary jaw is in said normally stationary position.

16. The locking pliers of claim 15, said indicator comprising a window aperture in said stationary assembly exposing an indicating area on said normally stationary jaw which is aligned with said window aperture only when said normally stationary jaw is in said normally stationary position.

* * * * *